US006946641B1

(12) United States Patent
Shimoi et al.

(10) Patent No.: US 6,946,641 B1
(45) Date of Patent: Sep. 20, 2005

(54) PHOTOMULTIPLIER TUBE

(75) Inventors: Hideki Shimoi, Hamamatsu (JP); Hiroyuki Kyushima, Hamamatsu (JP); Akira Atsumi, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

(21) Appl. No.: 10/275,682

(22) PCT Filed: May 8, 2000

(86) PCT No.: PCT/JP00/02928

§ 371 (c)(1),
(2), (4) Date: Nov. 8, 2002

(87) PCT Pub. No.: WO01/86691

PCT Pub. Date: Nov. 15, 2001

(51) Int. Cl.[7] ..... H01J 40/14
(52) U.S. Cl. ..... 250/214 VT; 250/207
(58) Field of Search ..... 250/207, 214 VT; 313/103 CM, 105 CM

(56) References Cited

U.S. PATENT DOCUMENTS

| | | | | |
|---|---|---|---|---|
| 3,951,698 A | | 4/1976 | Wilson et al. | 148/33.4 |
| 5,504,386 A | * | 4/1996 | Kyushima et al. | 313/103 R |
| 5,594,301 A | | 1/1997 | Sawai et al. | 313/523 |
| 5,864,207 A | * | 1/1999 | Kume et al. | 313/533 |
| 6,472,664 B1 | | 10/2002 | Kyushima et al. | 250/366 |
| 6,650,049 B1 | | 11/2003 | Kyushima et al. | 313/532 |
| 6,762,555 B1 | | 7/2004 | Kyushima et al. | 313/532 |

FOREIGN PATENT DOCUMENTS

| | | |
|---|---|---|
| JP | A 5-290793 | 11/1993 |
| JP | A 11-345587 | * 12/1999 |
| JP | 11-345588 | 12/1999 |
| JP | A 2000-149860 | 5/2000 |
| JP | 2000-149861 | 5/2000 |

OTHER PUBLICATIONS

U.S. patent application Ser. No. 10/275,654, Shimoi et al., filed Nov. 8, 2002.
U.S. Appl. No. 10/275,654, filed Nov. 08, 2002, Shimoi et al.

* cited by examiner

*Primary Examiner*—David Porta
*Assistant Examiner*—David C Meyer
(74) *Attorney, Agent, or Firm*—Oliff & Berridge, PLC

(57) ABSTRACT

A metal side tube (2), a glass faceplate (3), and a stem plate ( ) constitute a hermetically sealed vessel (5) for a photomultiplier tube. An edge portion (20) is provided at on open end (A) of the side tube (2). The edge portion (2) is embedded in the faceplate (3) in such a manner as to strike on the faceplate (3). Accordingly, high hermeticity at a joint between the side tube (2) and the faceplate (3) is ensured. The edge portion (20) extends upright in an axial direction of the side tube (2), so that the edge portion (20) can be embedded as close to a side face (3*c*) of the faceplate (3) as possible. This structure increases an effective sensitive area of the faceplate (3) to nearly 100%, and decreases dead area as close to 0 as possible. As described above, the photomultiplier tube (1) according to the present invention has enlarged effective sensitive area of the side tube (3) and enhanced hermeticity of the joint between the faceplate (3) and the side tube (2).

11 Claims, 6 Drawing Sheets

PHOTOMULTIPLIER TUBE

TECHNICAL FIELD

The present invention relates to a photomultiplier tube for detecting weak light incident on a faceplate by multiplying electrons emitted on the faceplate.

BACKGROUND ART

Japanese patent Kokai publication No. Hei 5-290793 discloses a photomultiplier tube includes an electron multiplier accommodated in a hermetically sealed vessel. The vessel has a metal side tube having a flange-shaped upper end. The flange-shaped end is welded to an upper surface of a faceplate, thereby ensuring airtightness of the vessel.

Referring to FIG. 10, the conventional photomultiplier tube described above has a flange 101 bent inwardly at the whole upper end of the side tube 100. The flange 101 results in the decrease in an effective sensitive area of a faceplate 102. If the faceplate 102 has a size of 50 mm×50 mm, and the flange 101 having a 1.5 mm width is fixed at and around a periphery of the faceplate 102, the sensitive effective area is clearly considered 88%. This type of photomultiplier tube has succeeded in obtaining more than 80% of a sensitive effective area. Recently, many photomultiplier tubes have been used and arranged as a unit for their applications. In those applications, photomultiplier tubes are required to have substantially 100% of sensitive effective area. In other words, photomultiplier tubes having substantially no dead sensitive area is necessary. As long as the side tube 100 and the faceplate 102 are joined by crimping the flange 101, a problem arises that the photomultiplier tubes have more than 10% of dead sensitive area. If a lot of conventional photomultiplier tube are juxtaposed densely, a substantial dead sensitive area may be easily produced. Japanese patent Kokai publication No. Hei 5-290793 discloses that the side tube 100 and the faceplate 102 are joined without using a flange. In the photomultiplier tube disclosed, the faceplate 102 is just in contact with an edge of the side tube 100. This publication has no disclosure on how to join the side tube 100 and the faceplate 102. As described above, a leak may occur from the hermetically sealed vessel, when the faceplate 102 is merely in contact with the edge of the side tube 100.

DISCLOSURE OF INVENTION

The present invention intends to solve the above problems. Especially, a main object of the present invention is to provide a photomultiplier tube having enlarged effective sensitive area of a photocathode and a hermetically sealed vessel with enhanced hermeticity.

To attain the above objects, the present invention features a photomultiplier tube including: a photocathode for emitting electrons in response to light incident on a faceplate; an electron multiplier in an hermetically sealed vessel for multiplying electrons emitted from the photocathode; and an anode for generating an output signal based on electrons multiplied by the electron multiplier. The hermetically sealed vessel includes: a stem plate for fixing the electron multiplier and the anode thereon by stem pins; a metal side tube having two open ends and enclosing the electron multiplier and the anode, the stem plate being fixed at the open end; and the faceplate fixed to one open end of the side tube, the faceplate being made of glass. The side tube has an edge portion at the other open end of side tube, the edge portion is embedded in the side of the photocathode on the faceplate.

The photomultiplier tube according to the present invention has the edge portion provided in the side tube. The edge portion is embedded in the manner that the edge portion penetrates into the glass faceplate. Thus, hermeticity at a joint between the side tube and the faceplate is ensured. The edge portion of the side tube extends straight from the side tube rather than laterally from the side tube like a flange. In the case when the edge portion is embedded as close to a side face of the faceplate, i.e., an outline of the faceplate, as possible, the effective surface area of the faceplate 3 is increased to nearly 100%, and the dead area of the faceplate 3 is minimized at nearly 0. As described above, a photomultiplier tube according to the present invention increases an effective sensitive area of the faceplate and enhances hermeticity between the side tube. and the faceplate on the basis of a different idea from those of conventional ones.

Preferably, the tip portion of the edge portion extends straight in the photomultiplier tube according to the present invention. This structure facilitates the penetration of an edge of the side tube into the faceplate. Additionally, enlarged effective sensitive area of the faceplate is ensured, because the edge portion is provided on a line extending from the edge portion.

Preferably, the edge portion has a tip portion curved outwardly or inwardly with respect to the side tube in the photomultiplier tube according to present invention. This structure can increase a contact area of the edge portion embedded in the faceplate with the faceplate, thereby contributing to enhanced hermeticity of the joint between the side tube and the faceplate.

Preferably, the edge portion has a knife-edged tip in the photomultiplier tube according to present invention. This structure facilitates penetration of an edge of the side tube into the faceplate. Reliability and improved assembly of the photomultiplier tube are ensured when the glass faceplate and the side tube are fused.

Preferably, the edge portion may have a single-edged tip. This structure increases a contact area between the edge portion and the faceplate, and enhances conformability of the side tube with glass material.

The edge portion may have a double-edged tip. This structure facilitates penetration of an edge of the side tube into the faceplate.

Preferably, the stem plate may be made of metal, an end face of the stem plate is in contact with an inner side wall of the side tube around the open end thereof, and the inner side wall and the end face are welded together. Accordingly, the photomultiplier tube has no projection like a flange at the lower end of the photomultiplier tube, because the side tube and the stem plate are welded together while the inner side wall of the side tube is in contact with the end face of the stem plate. This structure minimizes the whole size of the photomultiplier tube, though the above structure is improper for resistance-welding. The above structure enables many photomultiplier tubes to be juxtaposed densely. Accordingly, the photomultiplier tube in which the metal side tube and the metal faceplate are welded can be arranged at high density.

BEST MODE FOR CARRYING OUT THE INVENTION

Figure 1:
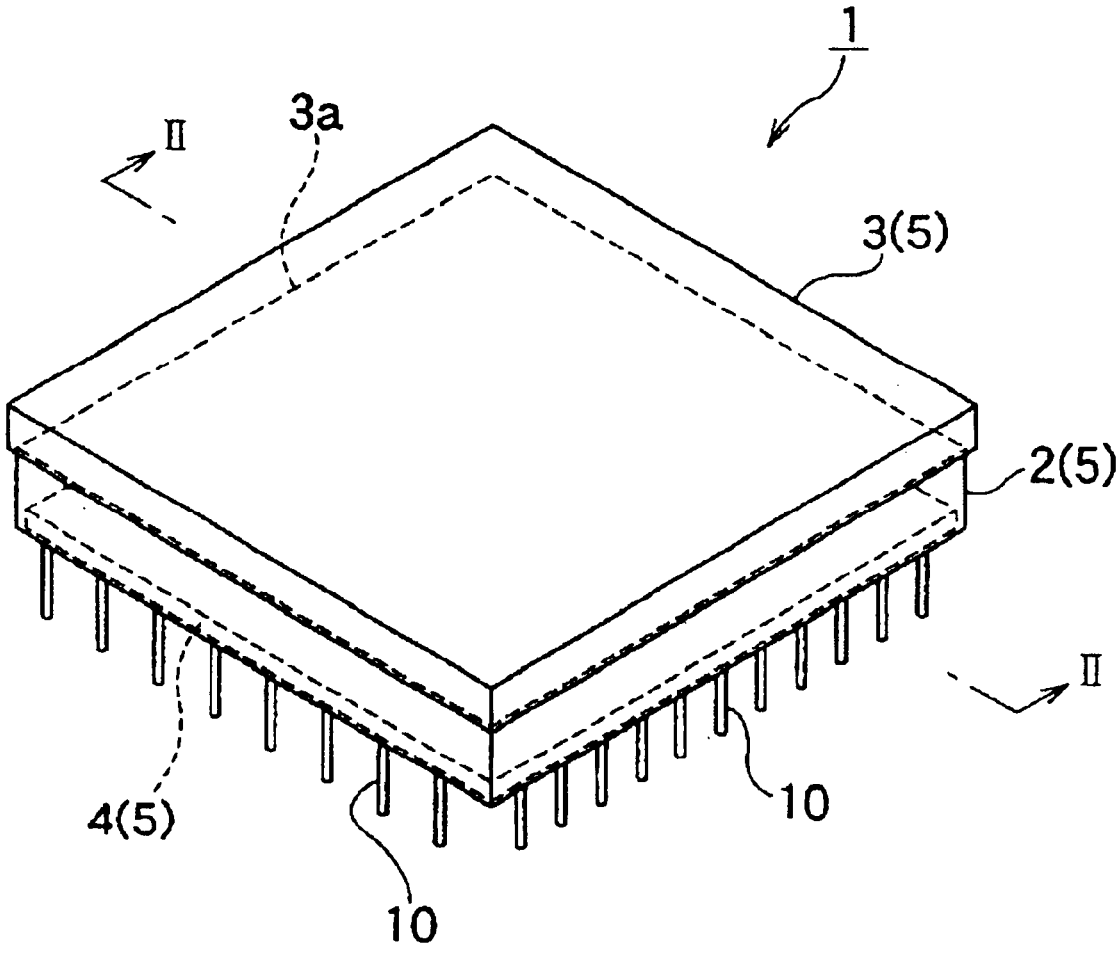
FIG. 1 is a perspective view showing one embodiment of a photomultiplier tube according to the present invention.

The following description will be made for explaining preferred embodiments of a photomultiplier tube according to the present invention, referring to the drawings.

Figure 2:
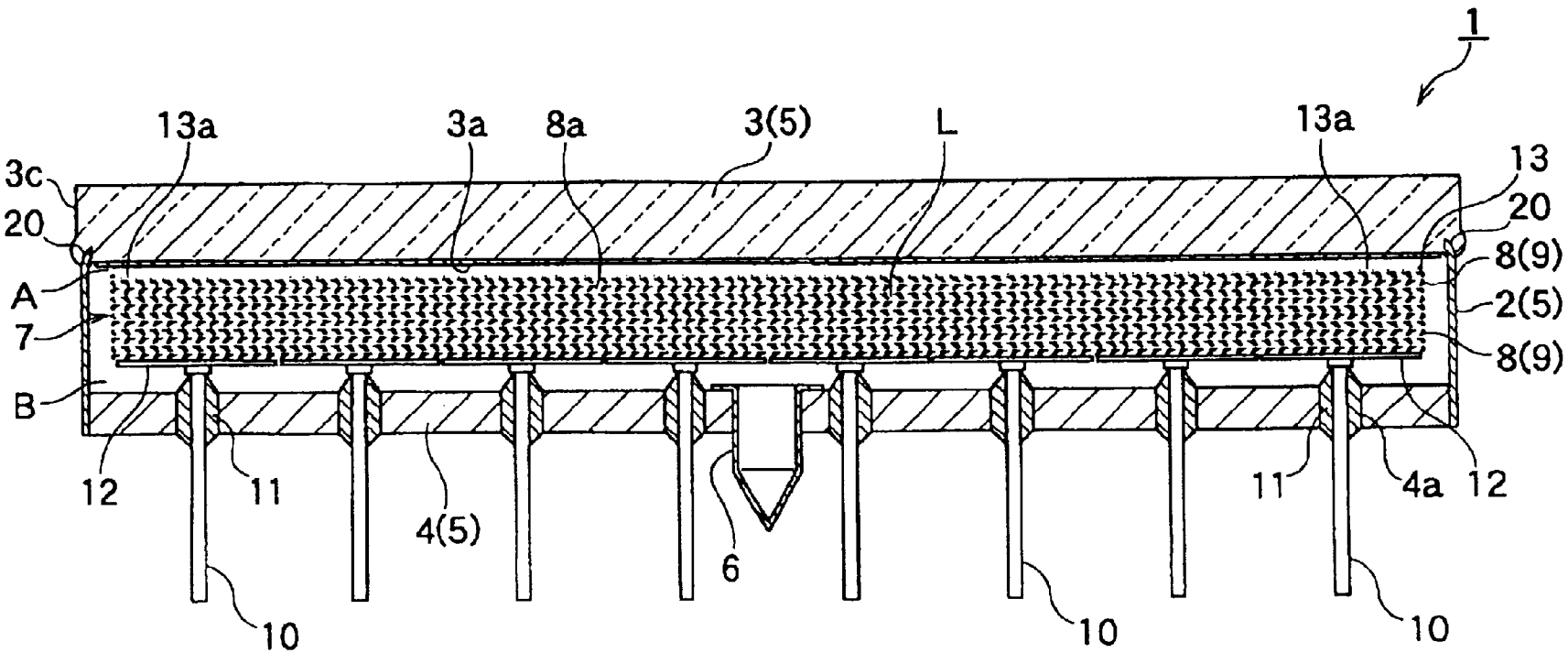
FIG. 2 is a sectional view taken along the line II—II of FIG. 1.

FIGS. 1 and 2 illustrate a photomultiplier tube 1 including a side tube 2 having substantially rectangular section and made of metal such as Kovar metal and stainless steel. The photomultiplier tube 1 also has a glass faceplate 3 fused to one open end A of the side tube 2. A photocathode 3*a* for converting light into an electron is formed on an inner side of the faceplate 3. The photocathode 3*a* is formed by reacting alkali metal vapor with antimony deposited on the faceplate 3. The photomultiplier tube 1 has a stem plate 4 welded to the other open end B of the side tube 2. The stem plate 4 is made from metal such as Kovar metal and stainless steel. The assembly of the side tube 2, the faceplate 3, and the stem plate 4 forms a hermetically sealed vessel 5 having a low height of substantially 10 mm.

A metal evacuating tube 6 is formed upright in the center of the stem plate 4. The metal evacuating tube 6 is used for evacuating the vessel 5 with a vacuum pump (not shown) after assembly of the photomultiplier tube 1 is finished. The metal evacuating tube 6 is also used to introduce alkali metal vapor. into the vessel 5 during formation of the photocathode 3*a*.

The stem plate 4 has a plurality of metal stem pins 10 made from Kovar pass through the stem plate 4. The stem plate 4 has pin holes 4*a* for the stem pins 10 to pass therethrough. The pin hole 4*a* is filled with tablet 11 made from Kovar glass as a hermetic seal. Each stem pin 10 is secured to the stem plate 4 by the tablet 11.

The vessel 5A accommodates an electron multiplier 7. The electron multiplier 7 is supported in the vessel 5 by the stem pins 10. The electron multiplier 7 has a stacked structure of a block shape. Ten stages of flat dynodes 8 are stacked into an electron multiplier section 9. Each dynode 8 is electrically connected to a tip of the stem pin 10. It should be noted that the stem pins 10 are classified into two groups: one group being connected to the dynodes 8; the other group being connected to an anode 12 described later.

The anodes 12 are positioned under the electron multiplying section 9 in the electron multiplier 7, and secured to the top ends of the anode pins. A flat focusing electrode 13 is disposed between the photocathode 3*a* and the electron multiplying section 9 over the top stage of the electron multiplier 7. A plurality of slit-shaped openings 13*a* is formed in the focusing electrode plate 13. The openings 13*a* are arranged parallel to each other in one direction. Slit-shaped electron multiplying holes 8*a* are formed in the dynode 8. The number of electron multiplying holes 8*a* is the same as that of the openings 13*a*. The electron multiplying holes 8*a* are arranged parallel to each other in a horizontal direction.

Electron multiplying paths L are provided by arranging the electron multiplying holes 8*a* of each dynode 8 in a perpendicular direction to the faceplate 3. A plurality of channels are formed in the electron multiplier 7 by aligning the electron multiplying path L with the corresponding opening 13*a* of the focusing electrode plate 13. The anodes 12 in the electron multiplier 7 are configured in an 8×8 arrangement, so that each anode 12 is associated with a predetermined number of channels. Since the anode 12 is connected to the corresponding stem pin 10, output signals for each channel can be retrieved through each anode pin 10B.

As described above, the electron multiplier 7 has a plurality of linear channels. A predetermined voltage is applied across the electron multiplying section 9 and the anodes 12 through the stem pin 10 connected to a bleeder circuit (not shown). The photocathode 3*a* and the focusing electrode plate 13 are set to be at the same potential. The potential of the dynode 8 is increased from the top stage of dynode toward the anodes 12. Therefore, incident light on the faceplate 3 is converted to electrons at the photocathode 3*a*. The electrons are guided into a certain channel by the electron lens effect generated by the focusing electrode plate 13 and the first stage of dynode 8 on the top of the electron multiplier 7. The electrons guided into the channel are multiplied by each stage of dynodes 8 while passing through the electron multiplying paths L. The electrons strike the anodes 12 to generate an individual output signal for the corresponding channel.

Figure 3:
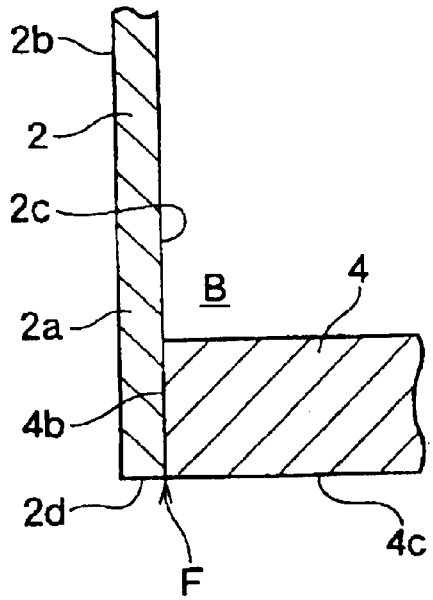
FIG. 3 is an enlarged sectional view showing a joint of a side tube and a stem plate of the photomultiplier tube according to the present invention.

Referring to FIG. 3, when the metal stem plate 4 and the metal side tube 2 are hermetically welded, an outer end face 4*b* of the stem plate 4 is brought into fit with an inner side wall 2*c* at the open end B of the side tube 2. Next, the stem plate 4 is inserted through the open end B to the side tube 2, so that the inner side wall 2*c* at a lower end 2*a* of the side tube 2 is brought into contact with an outer side face 4*b* of the stem plate 4. Additionally, a lower end face 2*d* of the side tube 2 is approximately flush with a lower face 4*c* of the stem plate 4, so that the lower end face 2*d* does not project lower than the stem plate 4. Thus, the above structure extends the outer side wall 2*b* at the lower end 2*a* of the side tube 2 in the substantial axial direction of the tube 2, and eliminates lateral projection like a flange at the lower end of the photomultiplier tube 1. In this state, a junction F between the side tube 2 and the stem plate 4 is laser-welded by irradiating a laser beam on the junction F from a point directly below and external to the junction F or in a direction toward the junction F.

By eliminating the flange-like overhang on the lower end of the photomultiplier tube 1, it is possible to reduce the external dimensions of the photomultiplier tube 1, though the above structure of the photomultiplier tube 1 and the side tube 2 may be improper for resistance-welding. Further, when several photomultiplier tubes 1 are arranged, it is possible to minimize dead space between neighboring photomultiplier tubes 1 as much as possible, thereby placing the side tube 2 of neighboring photomultiplier tubes 1 close together. Laser welding is employed to bond the stem plate 4 and side tube 2 as shown in FIG. 3 together in order to achieve a thin structure of the photomultiplier tube 1 and to enable high-density arrangements of the photomultiplier tube 1.

The above laser welding is one example for fusing the stem plate 4 and side tube 2. When the side tube 2 and the stem plate 4 are welded together using the laser welding, it is unnecessary to apply pressure across the junction F between the side, tube 2 and stem plate 4 in contrast to resistance welding. Hence, no residual stress is induced at the junction F, thereby avoiding cracks from occurring at this junction during the usage. The usage of the laser welding greatly improves the durability and sealability of the photomultiplier tube 1. Laser welding and electron beam welding prevent generation of heat at the junction F, compared to the resistance welding. Hence, when the photomultiplier tube 1 is assembled, there is very little effect of heat on the components in the vessel 5.

Figure 4:
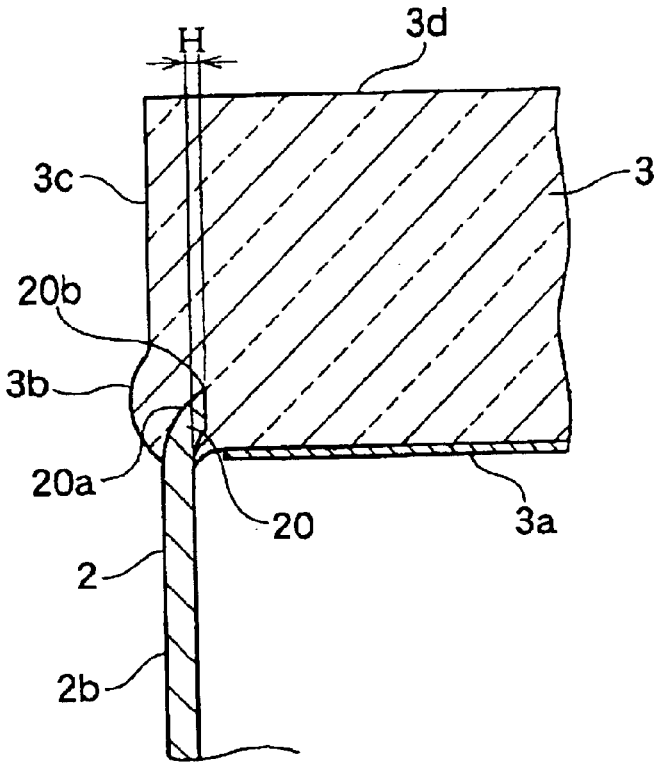
FIG. 4 is an enlarged sectional view showing a joint of a side tube and a faceplate of the photomultiplier tube according to the present invention.

The side tube 2 is formed by pressing a flat plate made from metal such as Kovar and stainless steel into an approximately rectangular cylindrical shape having a thickness of approximately 0.25 mm and a height of approximately 7 mm. The glass faceplate 3 is fixed to the open end A of the side tube 2 by fusion. As shown in FIG. 4, an edge portion 20 is formed on an upper end of the side tube 2 which the glass faceplate 3 faces. The edge portion 20 is to be brought into embedded in the photocathode 3*a* side of the faceplate 3 when a part of the faceplate 3 is welded by a high-frequency heating. The edge portion 20 is provided around the entire upper end of the side tube 2. The edge portion 20 is curved inwardly and smoothly with an R-shaped portion 20*a* on outer side wall 2*b* of the side tube 2. A tip 20*b* of the edge portion 20 is formed like a knife-edge extending in the axial direction of the side tube 2. Hence the upper end of the side tube 2 can easily pierce the glass faceplate 3, thereby facilitating the assembly process and improving reliability when the side tube 2 and glass faceplate 3 are fused together.

When fixing the side tube 2 with the edge portion 20 having the above shape to the glass faceplate 3, the metal side tube 2 is placed on a rotating platform (not shown) with the bottom surface of the glass faceplate 3 contacting the tip 20*b* of the edge portion 20 of the side tube 2. Next, the metal side tube 2 is heated by a high-frequency heating device while the glass faceplate 3 is pressed downwardly by a pressure jig. At this time, the heated edge portion 20 gradually melts the glass faceplate 3, and penetrates therein. As a result, the edge portion 20 is brought into embedded in the glass faceplate 3 while forming an expanding portion 3*b* at the lower end of the faceplate 3, ensuring a tight seal at the juncture between the glass faceplate 3 and side tube 2.

The expanding portion 3*b* is formed on only a part of the faceplate 3 in the vicinity of the edge portion 20. The formation of the expanding portion 3*b* does not cause whole deformation over the side face 3*c* of the faceplate 3. Accordingly, the formation of the expanding portion 3*b* does not affect the edge shape of the faceplate 3*d*. The flat shape of the faceplate 3 is maintained with reliability.

The edge portion 20 extends upward from the side tube 2 in an axial direction of the side tube 2 rather than extends laterally from the side tube 2 like a flange. The edge portion 20 can be embedded as close to a side surface 3*c* of the faceplate 3 as possible. This structure can increase the effective surface area of the faceplate 3 to nearly 100% and to minimize the dead area of the faceplate 3 at nearly 0. Additionally, the edge portion 20 is formed in the manner that it is smoothly curved inwardly of the side tube 2. Accordingly, a surface area of the embedded edge portion 20 in the faceplate 3 is enlarged, which contributes to enhanced hermeticity of the vessel 5. The edge portion 20 projects toward an interior of the side tube 2 by a small amount H of 0.1 mm. The edge portion 20 may be formed by pressing.

Figure 5:
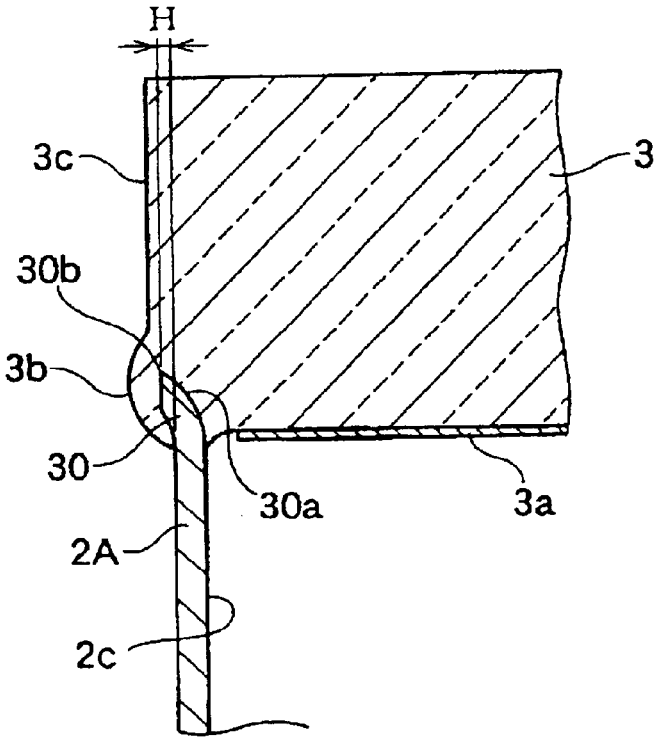
FIG. 5 is an enlarged sectional view showing a first modification of a side tube in a photomultiplier tube according to the present invention.

It should be noted that a side tube for use with a photomultiplier tube 1 according to the present invention is not limited to the embodiments described above. FIG. 5 shows a first modification. In this modification, an edge portion 30 is to be embedded in the photocathode 3*a* side of the faceplate 3 by high frequency heating. The edge portion 30 is formed at a tip portion (upper end) of the photocathode 3*a* side of the side tube 2A. The edge portion 30 extends in an axial direction of the side tube 2, and is provided on the whole upper end of the side tube 2A. The tip of the edge portion 20 is curved smoothly and outwardly of the side tube 2 with an R-shaped portion 30*a* on an inner side 2*c*. The tip 30*b* of the edge portion 30 is sharpened like a knife-edge extending in the axial direction of the side tube 2. Accordingly, the upper end of the side tube 2A is easy to penetrate the faceplate 3. This structure facilitates the assembly process and improves reliability when the side tube 2 and glass faceplate 3 are fused together. In this embodiment, the edge portion 30 of the side tube 2A is brought into embedded in the faceplate 3, while forming an expanding portion 3*b* at the lower end of the faceplate 3. Therefore, hermeticity is ensured at a joint portion of the faceplate 3 and the side tube 2A. Additionally, the edge portion 30 is curved smoothly and outwardly of the side tube 2, a surface area of the embedded edge portion 30 in the faceplate 3 is enlarged, so that a contact area between the side tube 2A and the faceplate 3 is also increased. This structure contributes to enhanced hermeticity of the vessel 5. The edge portion 30 projects out of the side tube 2A by a small amount H of 0.1 mm.

Figure 6:
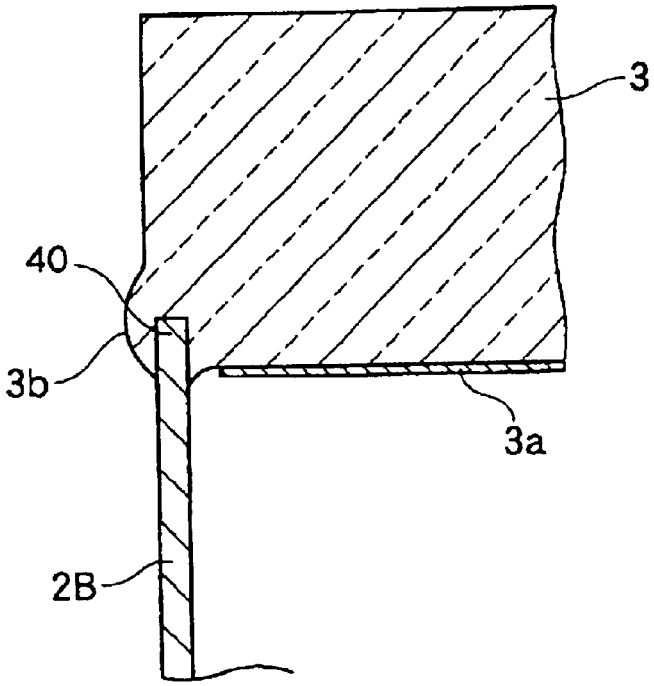
FIG. 6 is an enlarged sectional view showing a second modification of a side tube in a photomultiplier tube according to the present invention.

FIG. 6 shows a second modification. Referring to FIG. 6, an edge portion 40 extends straight in an axial direction of the side tube 2B. In this embodiment, the edge portion 40 is on an extending line of the side tube 2B. The edge portion 40 has a simple shape in a manner that the side tube 2B is just cut straight. A tip of the edge portion 40 may have a round shape in order to improve conformability to glass and increase a surface area of the edge portion 40.

Figure 7:
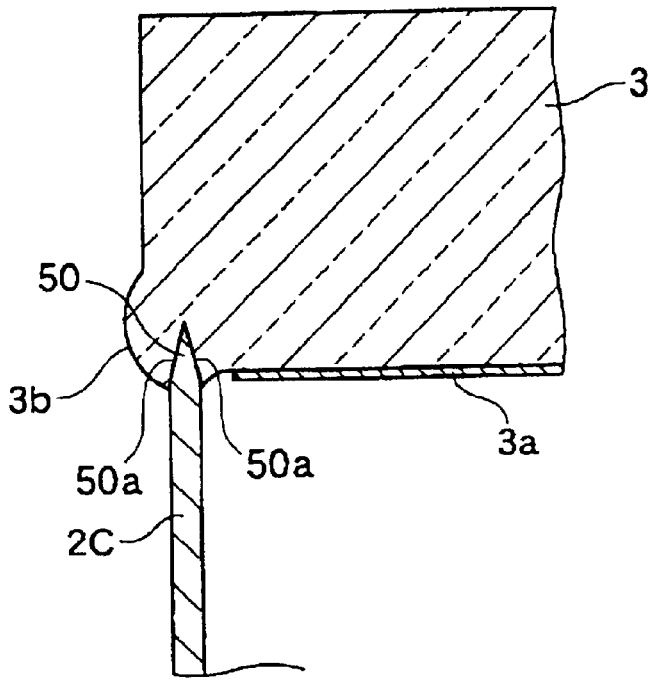
FIG. 7 is an enlarged sectional view showing a third modification of a side tube in a photomultiplier tube according to the present invention.

FIG. 7 shows a third modification. Referring to FIG. 7, an edge portion 50 extends straight in an axial direction of the side tube 2C. The edge portion 50 has a sharp tip consisting of double-edged faces 50*a*, 50*a*. This structure facilitates insertion of the side tube 2C into the faceplate 3, when the side tube 2C is welded with the faceplate 3.

Figure 8:
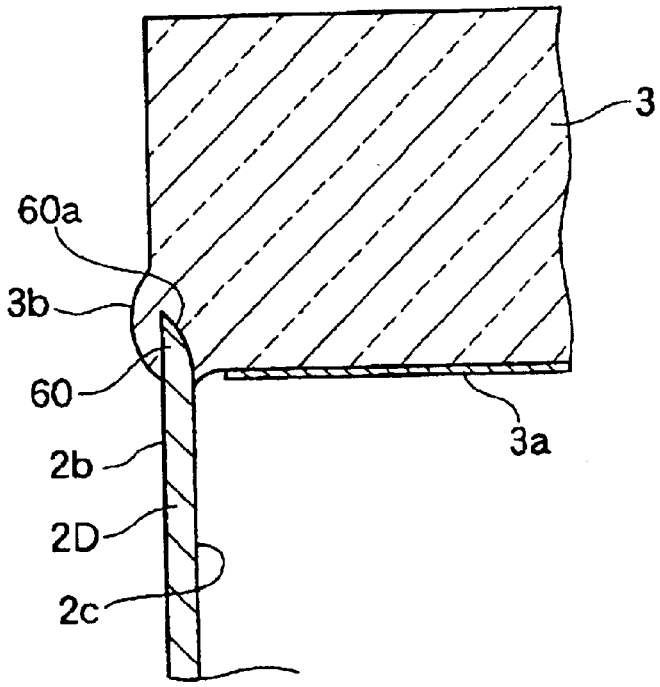
FIG. 8 is an enlarged sectional view showing a forth modification of a side tube in a photomultiplier tube according to the present invention.

FIG. 8 show s a forth modification, in which an edge portion 60 extends straight in an axial direction of the side tube 2D. The edge portion 60 has a single-edged tip end 60*a* on an inner side face of the side tube 2D. The knife-edge end 60*a* has a substantially an arc-shaped outline in order to enlarge a surface area of the edge portion 60 and enhance conformability with glass material.

Figure 9:
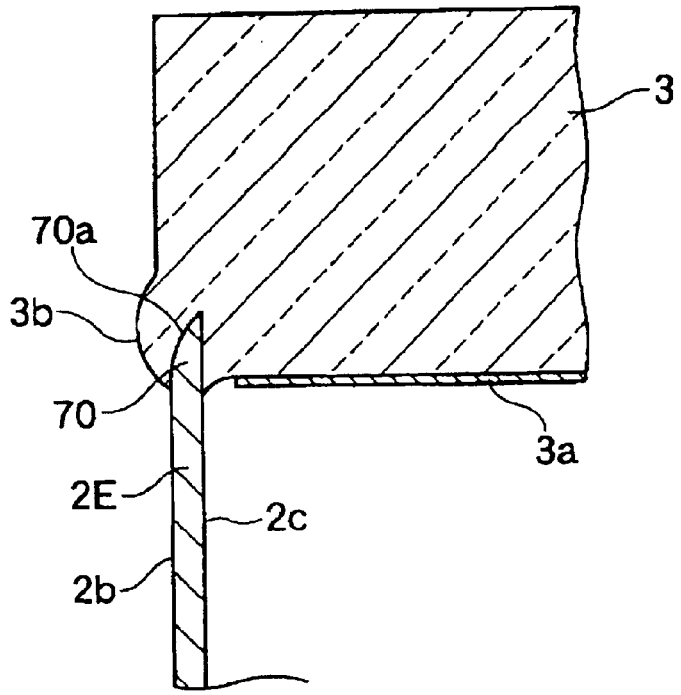
FIG. 9 is an enlarged sectional view showing a fifth modification of a side tube in a photomultiplier tube according to the present invention.
Figure 10:
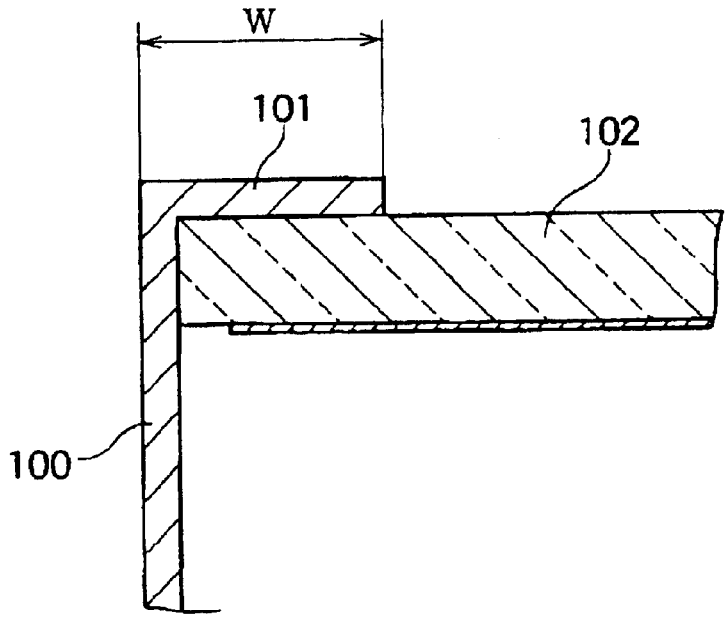
FIG. 10 is an enlarged sectional view showing a conventional side tube of a photomultiplier tube.

FIG. 9 shows a fifth modification, in which an edge portion 70 extends straight in an axial direction of the side tube 2E. The edge portion 70 has a single-edged tip end 70*a* on an outer side wall 2*b* of the side tube 2E. Thus, the tip of the edge portion 70 is sharp. The single-edged face 70*a* has an arc shaped outline in order to enlarge a surface area of the edge portion 70 and enhance conformability with glass.

The edge portion 70 may have a spherical shape or an arrowhead section.

INDUSTRIAL APPLICABILITY

A photomultiplier tube according to the present invention may be used with an imaging device for a lower luminescent area such as a monitoring camera, and night-vision equipment.

What is claimed is:

1. A photomultiplier tube comprising: a faceplate for receiving light incident thereon; a photocathode for emitting electrons in response to the light incident on the faceplate; an electron multiplier in a hermetically sealed vessel for multiplying electrons emitted from the photocathode; and an anode for generating an output signal based on electrons multiplied by the electron multiplier, wherein the hermetically sealed vessel includes:

a stem plate having stem pins for fixing the electron multiplier and the anode thereon;

a metal side tube having two open ends and enclosing the electron multiplier and the anode, the stem plate being fixed at one open end; and the faceplate having a surface for receiving the light thereon and an outer periphery side therearound, the faceplate being fixed to the other open end of the- metal side tube, the faceplate being made from glass, and wherein the metal side tube has an edge portion at the other open end of the metal side tube, the edge portion being embedded in the faceplate, thereby being positioned inside the outer periphery side of the faceplate.

2. The photomultiplier tube according to claim 1, wherein the edge portion has a tip end extending straight.

3. The photomultiplier tube according to claim 1, wherein the stem plate is made from metal, the metal side tube has an inner side wall extending between the two open ends, the stem plate has an outer peripheral face, the outer peripheral face of the stem plate is in contact with the inner side wall at the one open end of the side tube, to be welded therewith.

4. The photomultiplier tube according to claim 1, wherein the edge portion has a tip end curved toward one of an interior and an exterior of the metal side tube.

5. The photomultiplier tube according to claim 1, wherein the edge portion has a tip end with a knife-edged face.

6. The photomultiplier tube according to claim 5, wherein the tip of the edge portion has a single-edged face.

7. The photomultiplier tube according to claim 5, wherein the tip of the edge portion has a double edged face.

8. A photomultiplier tube comprising: a faceplate; a photocathode for emitting electrons in response to light incident on the faceplate; an electron multiplier in a hermetically sealed vessel for multiplying electrons emitted from the photocathode; and an anode for generating an output signal based on electrons multiplied by the electron multiplier, wherein the hermetically sealed vessel includes:

a stem plate having stem pins for fixing the electron multiplier and the anode thereon;

a metal side tube having two open ends and enclosing the electron multiplier and the anode, the stem plate being fixed at one open end; and the faceplate fixed to the other open end of the metal side tube, the faceplate being made from glass, and wherein the metal side tube has an edge portion at the other end of metal side tube, the edge portion being embedded in a photocathode side on the faceplate, the edge portion having a tip end curved toward one of an interior and an exterior of the metal side tube.

9. A photomultiplier tube comprising: a faceplate; a photocathode for emitting electrons in response to light incident on the faceplate; an electron multiplier in a hermetically sealed vessel for multiplying electrons emitted from the photocathode, and an anode for generating an output signal based on electrons multiplied by the electron multiplier, wherein the hermetically sealed vessel includes:

a stem plate having stem pins for fixing the electron multiplier and the anode thereon:

a metal side tube having two open ends and enclosing the electron multiplier and the anode, the stem plate being fixed at one open end; and the faceplate fixed to the other open end of the metal side tube, the faceplate being made from glass, and wherein the metal side tube has an edge portion at the other open end of metal side tube, the edge portion being embedded in a photocathode side on the faceplate, the edge portion having a tip end with a knife-edged face.

10. The photomultiplier tube according to claim 9, wherein the tip of the edge portion has a single-edged face.

11. The photomultiplier tube according to claim 9, wherein the tip of the edge portion has a double-edged face.

* * * * *

UNITED STATES PATENT AND TRADEMARK OFFICE

CERTIFICATE OF CORRECTION

PATENT NO. : 6,946,641 B1
APPLICATION NO. : 10/275682
DATED : September 20, 2005
INVENTOR(S) : Hideki Shimoi, Hiroyuki Kyushima and Akira Atsumi It is certified that error appears in the above-identified patent and that said Letters Patent is hereby corrected as shown below:

Please replace claims 1-11 at column 7, line 7, through column 8, line 44 with the following correct claims 1-4:

--1. A photomultiplier tube comprising: a faceplate; a photocathode for emitting electrons in response to light incident on the faceplate; an electron multiplier in a hermetically sealed vessel for multiplying electrons emitted from the photocathode; and an anode for generating an output signal based on electrons multiplied by the electron multiplier, wherein the hermetically sealed vessle includes:

a stem plate having stem pins for fixing the electron multiplier and the anode thereon;

a metal side tube having two open ends and enclosing the electron multiplier and the anode, the stem plate being fixed at one open end; and the faceplate fixed to the other open end of the metal side tube, the faceplate being made from glass, and wherein the metal side tube has an edge portion at the other end of metal side tube, the edge portion being embedded in a photocathode side on the faceplate, the edge portion having a tip end curved toward one of an interior and an exterior of the metal side tube.

2. A photomultiplier tube comprising: a faceplate; a photocathode for emitting electrons in response to light incident on the faceplate; an electron multiplier in a hermetically sealed vessel for multiplying electrons emitted from the photocathode; and an anode for generating an output signal based on electrons multiplied by the electron multiplier, wherein the hermetically sealed vessel includes:

a stem plate having stem pins for fixing the electron multiplier and the anode thereon;

a metal side tube having two open ends and enclosing the electron multiplier and the anode, the stem plate being fixed at one open end; and

UNITED STATES PATENT AND TRADEMARK OFFICE

CERTIFICATE OF CORRECTION

PATENT NO. : 6,946,641 B1
APPLICATION NO. : 10/275682
DATED : September 20, 2005
INVENTOR(S) : Hideki Shimoi, Hiroyuki Kyushima and Akira Atsumi It is certified that error appears in the above-identified patent and that said Letters Patent is hereby corrected as shown below:

the faceplate fixed to the other open end of the metal side tube, the faceplate being made from glass, and wherein the metal side tube has an edge portion at the other open end of metal side tube, the edge portion being embedded in a photocathode side on the faceplate, the edge portion having a tip end with a knife-edged face.

3. The photomultiplier tube according to claim 2, wherein the tip of the edge portion has a single-edged face.

4. The photomultiplier tube according to claim 2, wherein the tip of the edge portion has a double-edged face.--

Signed and Sealed this

Nineteenth Day of September, 2006

JON W. DUDAS
*Director of the United States Patent and Trademark Office*